US007179107B2

(12) United States Patent
Shen et al.

(10) Patent No.: US 7,179,107 B2
(45) Date of Patent: Feb. 20, 2007

(54) CONNECTOR FOR FLEXIBLE PRINTED CIRCUIT

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/489,181

(22) Filed: Jul. 19, 2006

(65) Prior Publication Data

US 2007/0020982 A1 Jan. 25, 2007

(30) Foreign Application Priority Data

Jul. 20, 2005 (CN) ..... 2005 2 0073835

(51) Int. Cl.
*H01R 11/22* (2006.01)

(52) U.S. Cl. ..... 439/267

(58) Field of Classification Search ..... 439/260, 439/266, 352, 495, 254, 259
See application file for complete search history.

(56) References Cited

U.S. PATENT DOCUMENTS 5,173,058 A 12/1992 Broeksteeg et al.
6,997,729 B2 * 2/2006 Sunaga ..... 439/260
7,083,454 B2 * 8/2006 Suzuki ..... 439/260
2003/0087544 A1 * 5/2003 Nogawa et al. ..... 439/260
2006/0105622 A1 * 5/2006 Nakano et al. ..... 439/495
2006/0205257 A1 * 9/2006 Suzuki et al. ..... 439/260

* cited by examiner

*Primary Examiner*—Phuong Dinh
(74) *Attorney, Agent, or Firm*—Wei Te Chung

(57) ABSTRACT

A connector (100) for connecting a sheet-like electronic member includes a housing (10); a number of terminals (20) loaded in the housing, said terminal including a first and second beams (21 and 22) defining a gap therebetween; and an actuator (30) pivotally movable between an open position and a closed position relative to the housing. The actuator is provided with cam portions (310) engaging with the terminals so as to broaden the gap between the first and second beams when the actuator is at the open position for facilitating the sheet-like electronic member to enter, and to allow said gap to narrow when the actuator is at the closed position so that the sheet-like electronic member can be clasped and retained by the first and second beams, and retaining portions (311) adapted for engaging with and further retaining the sheet-like electronic member.

1 Claim, 7 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC".

2. Description of Related Art

U.S. Pat. No. 5,173,058 discloses a connector including an insulative housing, a plurality of contacts retained in the housing, and an actuator assembled to the housing and movable between an open position and a closed position relative to the housing. The contact includes an upper beam and a lower beam respectively formed with a contact portion. The two contact portions respectively formed on the upper and lower beams of the contact protruding towards each other and defining therebetween a gap for receiving an FPC. The actuator is provided with a plurality of cam portions each pivotally engaging with the corresponding upper beam. When the actuator is at the open position, the cam portion props up the upper beam to broaden the gap between the two contact portions so that the FPC can be inserted thereinto with zero-insertion-force, and when the actuator is at the closed position, the upper beam resile so that the two contact portions can clasp the FPC received therebetween to establish electrical connection between the FPC and the contacts of the connector. However, in such a connector, the FPC is retained merely through the two contact portions that clasp it, and thus is apt to be drawn out of the connector since the clasping force due to the resilience of the upper and lower beams is rather weak. Therefore the electrical connection between the FPC and the connector can be ensured.

Thus it is desired to provide a connector to overcome above-mentioned disadvantage.

SUMMARY OF THE INVENTION

An object of the present invention is to provide a connector for connecting an FPC in which the FPC is firmly retained against being drawn therefrom.

In order to achieve above-mentioned object, a connector for connecting an FPC in accordance with a preferred embodiment of the present invention includes an insulative housing; a number of terminals loaded in the housing and each including a first and second beams defining a gap therebetween for receiving the FPC; and an actuator pivotally movable between an open position and a closed position relative to the housing, wherein the actuator is provided with cam portions engaging with the terminals so as to broaden the gap between the first and second beams when the actuator is at the open position for facilitating the sheet-like electronic member to enter, and to allow said gap to narrow when the actuator is at the closed position so that the sheet-like electronic member can be clasped and retained by the first and second beams, and retaining portions adapted for engaging with and further retaining the sheet-like electronic member.

Other objects, advantages and novel features of the present invention will become more apparent from the following detailed description of the present embodiment when taken in conjunction with the accompanying drawings.

DETAILED DESCRIPTION OF THE INVENTION

Figure 1:
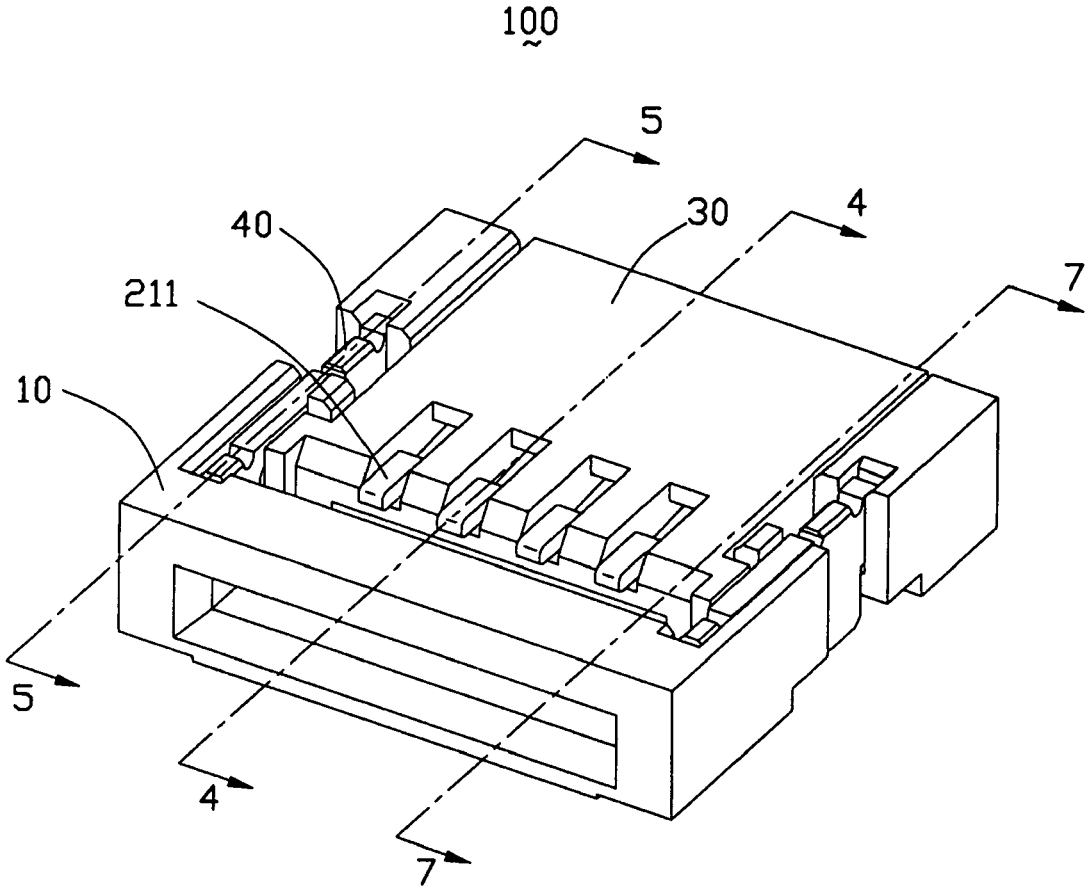
FIG. 1 is an assembled perspective view of a connector in accordance with the preferred embodiment of the present invention.

Reference will now be made to the drawing figures to describe the preferred embodiment of the present invention in detail.

Figure 2:
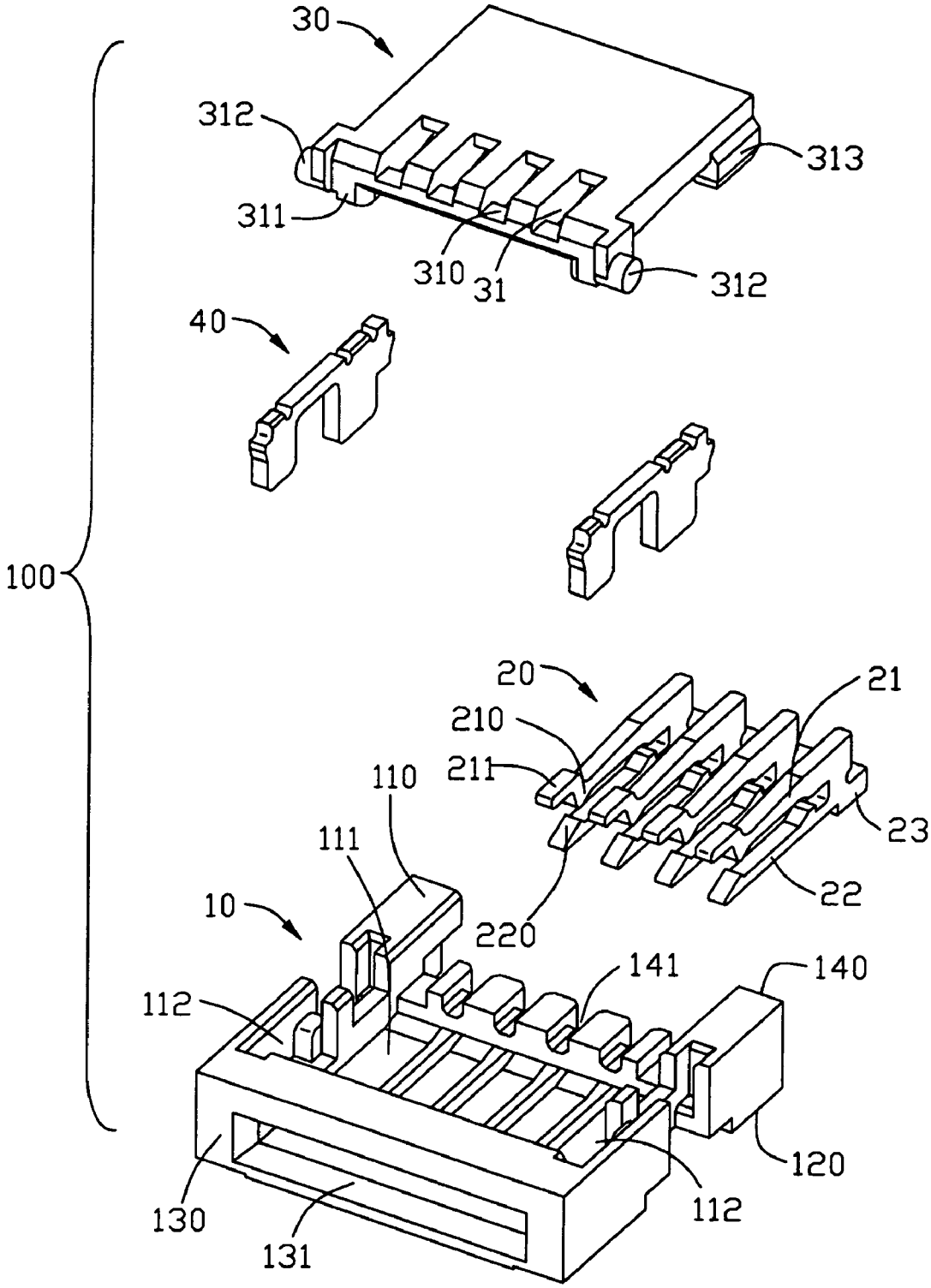
FIG. 2 is an exploded perspective view of the connector.
Figure 3:
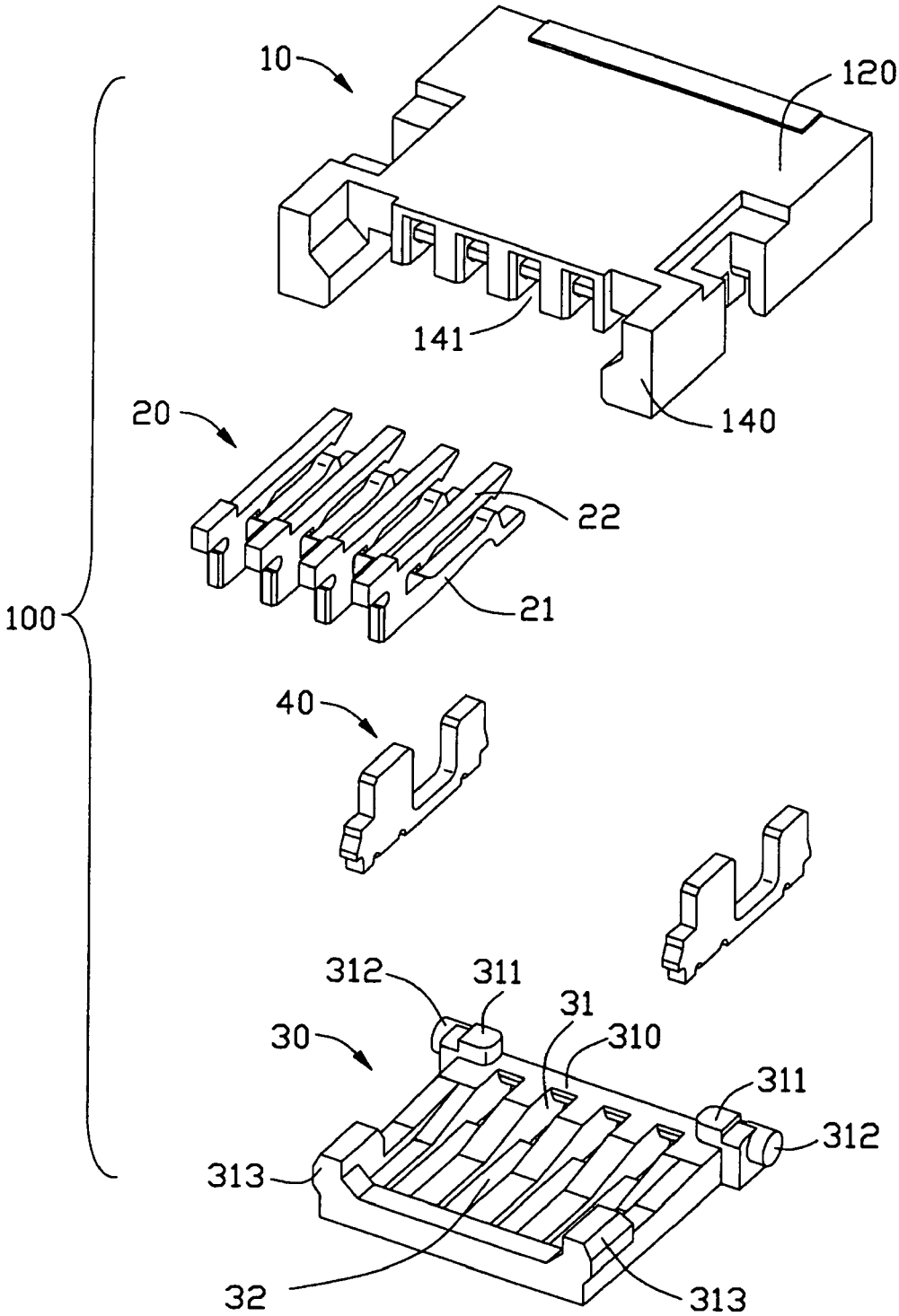
FIG. 3 is another exploded perspective view of the connector taken from a second aspect.

Referring to FIGS. 1–3, a connector 100 for connecting an FPC (numbered as 5 in FIG. 7) to a circuit board (not shown) in accordance with the preferred embodiment of the present invention comprises an insulative housing 10, a plurality of metal terminals 20 loaded in the housing 10, an actuator 30 movably assembled to the housing 10, and a pair of retaining ears 40.

The housing 10 comprises a top face 110, a mounting face 120 opposite to the top face 110, a front face 130, and a rear face 140 opposite to the front face 130. The housing 10 defines an opening 111 in the top face 110 thereof for accommodating the actuator 30, a plurality of terminal-fixing grooves 141 in the rear face 140 thereof, and an FPC-inserting port 131 in the front face 130 thereof. Both the terminal-fixing grooves 141 and the FPC-inserting port 131 communicate with the opening 111. The housing 10 further defines a pair of recesses 112 in the top face 110 respectively adjacent to two lateral sides thereof for receiving the retaining ears 40.

Figure 4:
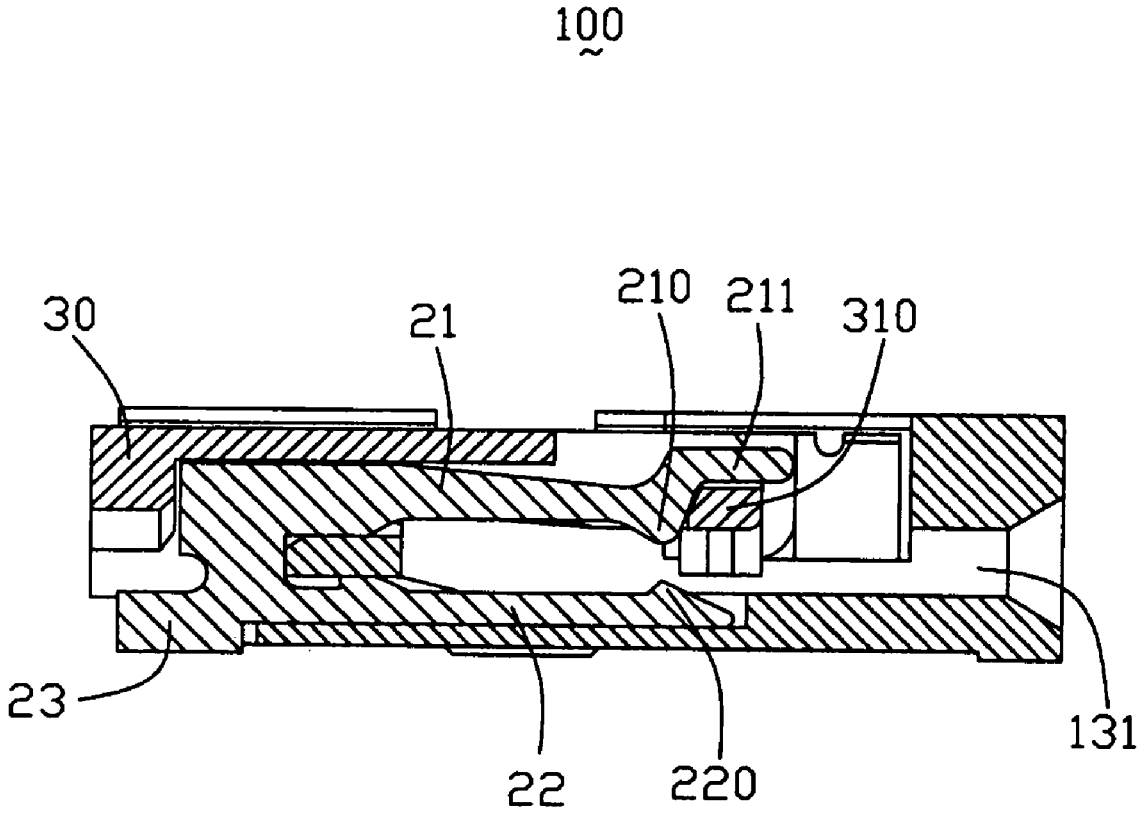
FIG. 4 is a cross-sectional view of the connector taken along line 4—4 in FIG. 1, showing an actuator thereof at a closed position.

Referring to FIGS. 2 and 4, the terminals 20 are assembled into the housing 10 from a rear side of the housing 10 and are respectively fixed in the grooves 141. Each terminal 20 comprises a base (not labeled), an upper beam 21 and a lower beam 22 which extend substantially parallel to each other from the base and define therebetween a gap for receiving the FPC, and a solder portion 23 extending from the base for being soldered to the circuit board. There are two contact protuberances 210, 220 respectively formed on the upper and lower beams 21, 22 and protruding towards each other to clasp the FPC and contact the corresponding conductor on the FPC. The upper beam 21 additionally has a pivotal portion 211 extending upwards and then forwards from the contact protuberance 210. In assembly, the upper beam 21 extends forwards as a cantilever, which can perform a deflectable resilience, and the lower beam 22 substantially abuts on the bottom wall of the housing 10 to save a space in the connector since it is not required to perform deflectable resilience. The two contact protuberances 210, 220 and the pivotal portion 211 are disposed adjacent to the FPC-inserting port 131.

Figure 7:
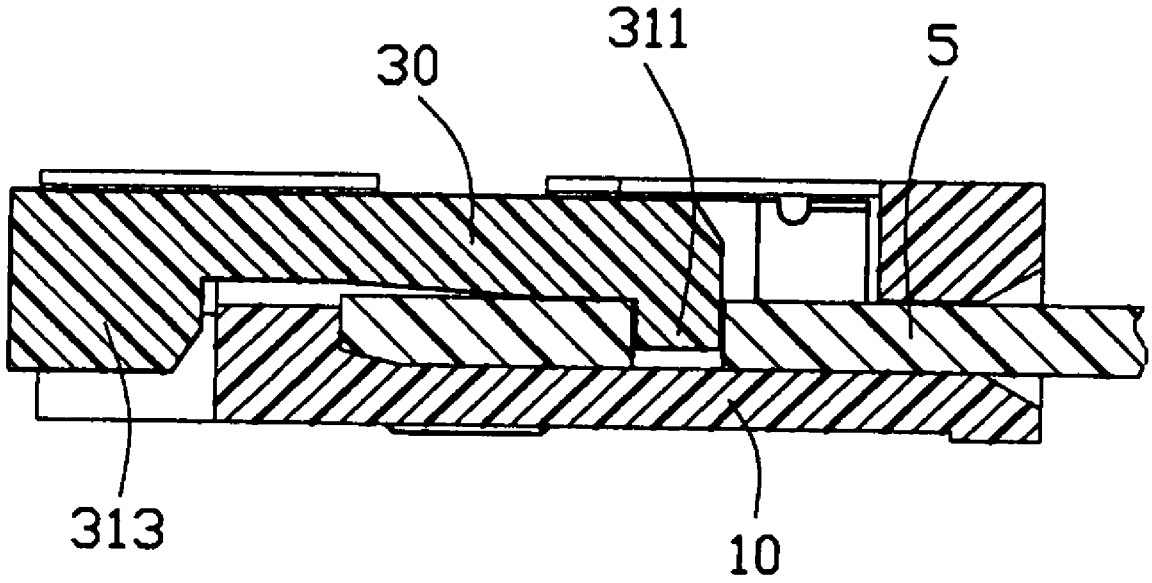
FIG. 7 is a cross-sectional view taken along line 7—7 in FIG. 1, further including an FPC inserted in the connector, and specially showing an engagement between the actuator and the FPC.

Referring to FIGS. 2 and 3, the actuator 30 is formed into a plate form to open and close the opening 111, and is provided with an engaging edge for pivotally engaging with the terminals 20 and the housing 10. The engaging edge is formed with a plurality of through holes 31 provided for the pivotal portions 211 of the terminals 20 to go through during pivotal rotation of the actuator 30, a plurality of cam portions 311 provided by the forming of the through holes 31, and a pair of end shafts 312 respectively extending from longitudinal ends thereof. The actuator 30 defines a plurality of channels 32 each correspondingly communicating with the through hole 31 and adapted for accommodating the upper beams 21 of the terminals 20 and providing a space for resilient deflection of the upper beams 21. The actuator 30 further has a pair of retaining blocks 311 formed at the engaging edge thereof, and a pair of lockers 313 formed at an operating edge which is opposite to the engaging edge. Correspondingly, the FPC will define cutouts for engaging with the retaining blocks 311, as shown in FIG. 7.

Figure 5:
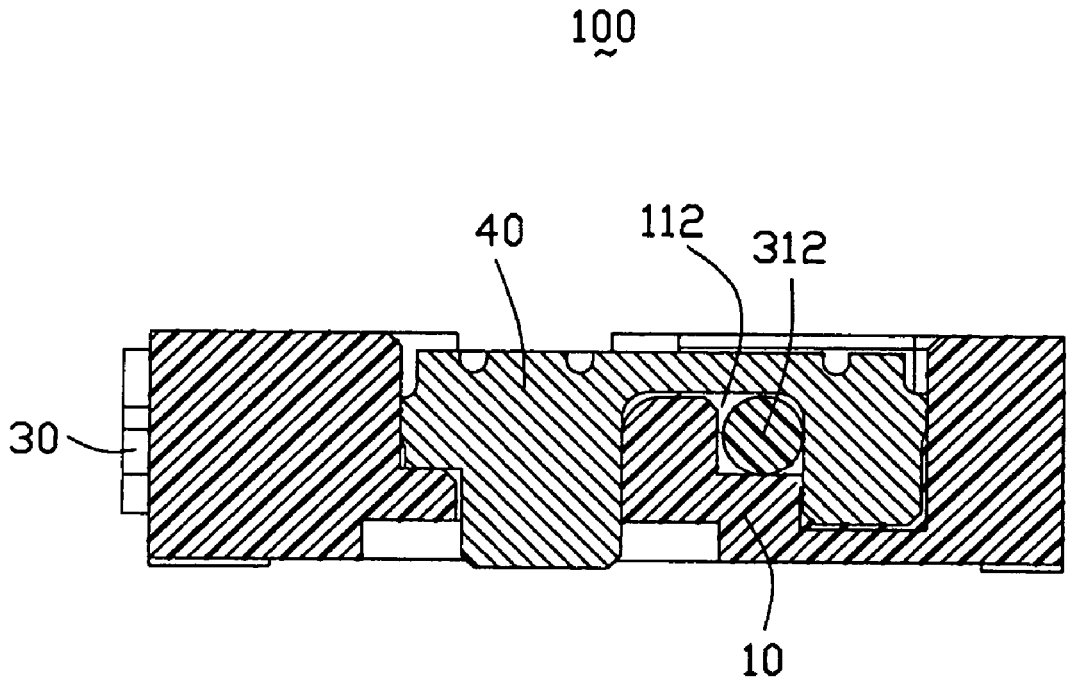
FIG. 5 is a cross-sectional view of the connector taken along line 5—5 in FIG. 1.

Referring to FIGS. 1–2 in conjunction with FIG. 5, while assembling, firstly the terminals 20 are fixed into the housing 10 in a fashion that the base thereof is disposed in the rear section of the housing 10 and the upper and lower beams 21, 22 thereof extend forwards towards the FPC-inserting port 131, then the actuator 30 is slanted to have the end shafts 312 thereof received in the recesses 112 and the cam portions 311 thereof each disposed below the corresponding pivotal portion 211 of terminal 20, and lastly, the retaining ears 40 are assembled into the recesses 112 from an upside of the housing 10 to restrain the end shafts 312 from moving along a front-to-back direction or upwardly moving out of the recesses 112, however, allowing the end shafts 312 to freely rotate, as best shown in FIG. 5.

Figure 6:
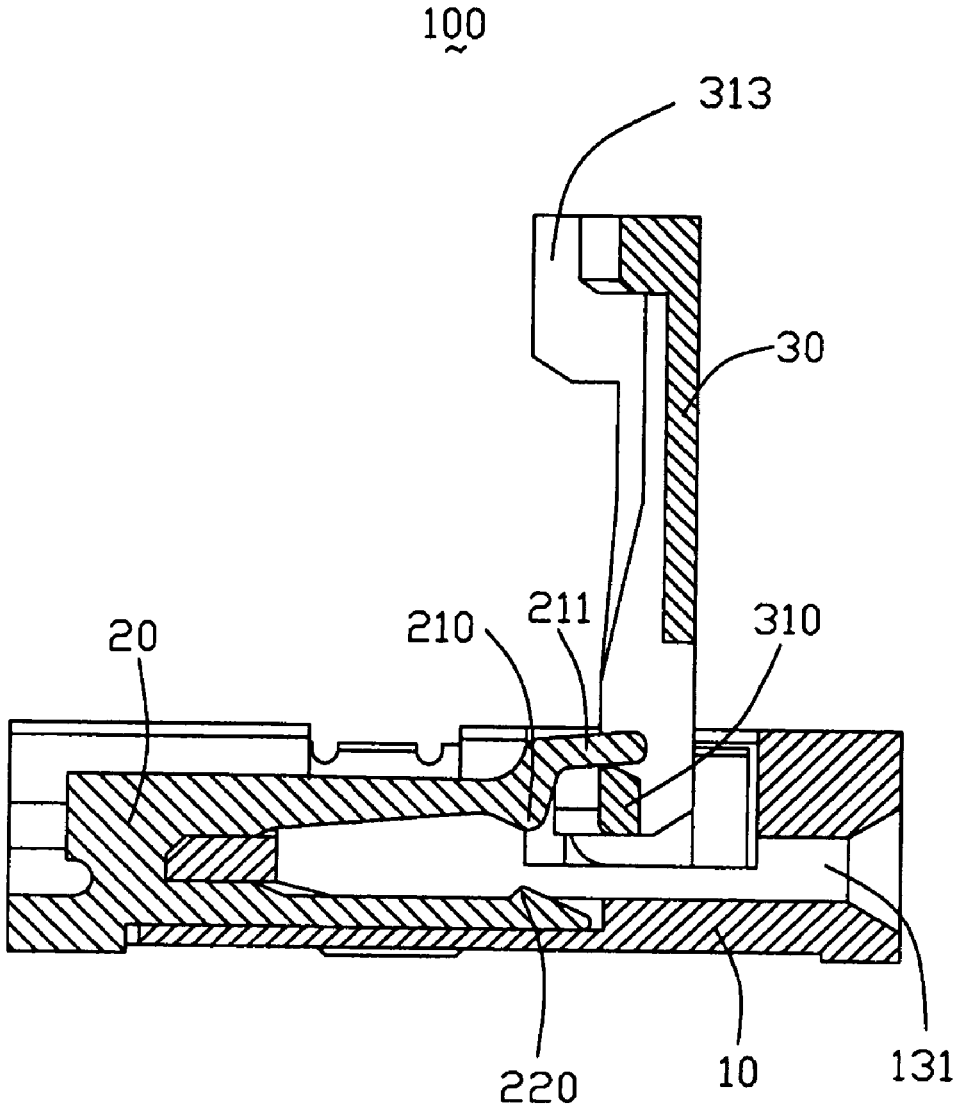
FIG. 6 is a cross-sectional view similar to FIG. 4, showing the actuator at an open position.

Referring to FIGS. 4 and 6, in assembly, the actuator is pivotally rotatable between an open position and a closed position relative to the housing 10. When at the open position, as shown in FIG. 6, the actuator 30 has the longer axis of the cam portion 310 thereof erected to prop up the pivotal portion 211 of the upper beam 21 so as to broaden the gap between the two contact protuberances 210, 220 to receive the FPC. After the actuator 30 pivoting on the end shafts 312 thereof is rotated to the closed position, the shorter axis of the cam portion 310 has been rotated in the vertical direction, as shown in FIG. 4, thus the upper beam 21 can resile to original position. As the distance between the two contact protuberances 210, 220 while the upper beam 21 is at its original position is smaller than the thickness of the FPC, the FPC received in the gap between the two contact protuberances 210, 220 is clasped and retained therein, and electrical connection between the FPC and the connector 100 therefore is established. In additional, as shown in FIG. 7, the retaining blocks 311 on the actuator 30 engage with the cutouts defined in the FPC and the lockers 313 engage with recesses defined in the rear section of the housing 10, thereby to further retain the FPC in the connector 100 firmly while the actuator 30 is at its closed position. Moreover, in this preferred embodiment, the whole actuator 30 is substantially accommodated in the opening 111 while at the closed position, which minimizes the whole profile of the connector 100.

However, the disclosure is illustrative only, changes may be made in detail, especially in matter of shape, size, and arrangement of parts within the principles of the invention.

What is claimed is:

1. An electrical connector adapted for connecting a sheet-like electronic member, comprising:

an insulative housing;

a plurality of terminals loaded in the housing, said terminal including a first and second beams defining a gap therebetween for receiving the sheet-like electronic member; and an actuator pivotally movable between an open position and a closed position relative to the housing, the actuator provided with cam portions engaging with the terminals so as to broaden the gap between the first and second beams when the actuator is at the open position for facilitating the sheet-like electronic member to enter, and to allow said gap to return to the original dimension when the actuator is at the closed position so that the sheet-like electronic member is clasped and retained by the first and second beams, and retaining portions adapted for engaging with and further retaining the sheet-like electronic member, wherein the housing defines an upward opening able to accommodate the actuator while at the closed position, wherein the first beam is deflectable, and the actuator defines channels providing space for deflection of the first beam, wherein the second beam abuts on the housing and substantially is not vertically deflectable, wherein the retaining portion is formed at the same edge of the actuator with the cam portions, wherein the housing defines a front face and a rear face opposite to the front face, and the actuator has an engaging edge formed by the cam portions and an operating edge opposite to the engaging edge, and wherein the engaging edge is adjacent to said front face while the operating edge is adjacent to said rear face when the actuator is at the closed position, wherein the operating edge is provided with a locker for locking to the housing when the actuator is at the closed position, wherein the housing defines an inserting port in the front face thereof communicating with the gaps between the first and second beams of the terminals and a pair of retaining ears for retaining the actuator to the housing, wherein the actuator has a pair of end shafts retained between the housing and the retaining ear and thereby prevented from movement along front-to-back or vertical direction but allowed to freely rotate.

* * * * *